US006151724A

United States Patent [19]

Klingenstein

[11] Patent Number: 6,151,724

[45] Date of Patent: Nov. 28, 2000

[54] TOILET TANK WATER CONSERVATION DEVICE

[76] Inventor: Roland C. Klingenstein, 3461 W. Quail Run Rd., Pahrump, Nev. 89048

[21] Appl. No.: 09/429,919

[22] Filed: Oct. 29, 1999

Related U.S. Application Data

[60] Provisional application No. 60/109,739, Nov. 24, 1998.

[51] Int. Cl.[7] ..... E03D 3/00; E03D 3/12

[52] U.S. Cl. ..... 4/323; 4/325; 4/415

[58] Field of Search ..... 4/323, 394, 415, 4/324, 325

[56] References Cited

U.S. PATENT DOCUMENTS

| | | | |
|---|---|---|---|
| 4,937,895 | 7/1990 | Stevens | 4/415 X |
| 5,023,960 | 6/1991 | Ratanagsu | 4/394 X |
| 5,062,166 | 11/1991 | Krenecki | 4/415 X |
| 5,073,995 | 12/1991 | Jennison et al. | 4/415 |
| 5,103,507 | 4/1992 | Sprajc et al. | 4/415 X |
| 5,185,891 | 2/1993 | Rise | 4/324 |
| 5,191,661 | 3/1993 | Chang | 4/415 X |
| 5,333,331 | 8/1994 | Battle | 4/324 |
| 5,341,522 | 8/1994 | Munro | 4/415 |
| 5,375,269 | 12/1994 | Schmitz | 4/415 |
| 5,548,849 | 8/1996 | Sulit | 4/415 X |
| 5,784,726 | 7/1998 | Kay | 4/324 |

*Primary Examiner*—Henry J. Recla
*Assistant Examiner*—Kathleen J. Prunner
*Attorney, Agent, or Firm*—Richard C. Litman

[57] ABSTRACT

The toilet tank water conservation device has a bracket adapted for attachment to the overflow tube of a toilet tank. The bracket includes a guide ledge having a bore defined therein. The device includes a float ball attached to a cylindrical guide rod, the rod being slidable through the bore defined in the guide ledge. The device is installed so that when the toilet tank is flushed, the water level drops and the ball drops by gravity, striking the flapper flush and closing the flush valve early in order to (1) conserve water by limiting the amount of water released from the tank into the bowl, and consequently (2) decreasing the likelihood of overflow from the toilet bowl in the event of a clogged drain. The device may include a flange about the circumference of the rod in order to prevent the rod from sliding through the bore when water drains from the tank.

5 Claims, 2 Drawing Sheets

TOILET TANK WATER CONSERVATION DEVICE

CROSS-REFERENCE TO RELATED APPLICATION

This application claims the benefit of U.S. Provisional Patent Application Serial No. 60/109,739, filed Nov. 24, 1998.

BACKGROUND OF THE INVENTION

1. Field of the Invention

The present invention relates to toilet mechanisms, and particularly to a water conservation device to conserve water in the toilet tank.

2. Description of Related Arts

The present invention relates to a toilet tank system which has a flapper valve between the toilet tank and the toilet bowl. In a conventional system, when the handle is operated to flush the toilet, the flapper valve is pulled off the flush valve seat. The water in the tank flows through the tank outlet into the bowl or into the leg of a trap of the bowl, causing the water to empty rapidly from the tank and flush the bowl through a siphoning action. When the handle is released, the flapper valve floats in the tank water until substantially all of the water is released from the tank, after which it seals the valve seat. The tank then refills with water until a float in the tank rises with the water level to close the float valve in the ballcock assembly, leaving a premeasured quantity of water in the tank until the next flush cycle.

In recent years concern for water shortages has led to the observation that the quantity of water released from the toilet tank exceeds the volume necessary for adequately flushing the toilet bowl by anywhere between 30% and 50%. In response to this observation, a number of devices have been contrived for the purpose of limiting the amount of water released from the water tank during a flush cycle. Limiting the amount of water released from the water tank during the flush cycle also has the secondary effect of reducing the risk of water overflowing the tank bowl in the event of a clogged toilet.

U.S. Pat. No. 4,937,895, issued Jul. 3, 1990 to C. F. Stevens, discloses an upright tube slidably disposed about the overflow tube, the upright tube having a valve actuator mounted above the flapper valve in order to press the valve down on the valve seat, and also having a float causing the upright tube and valve actuator to rise and fall with the water level, the float partially filling with water to counteract its buoyancy. U.S. Pat. No. 5,023,960, issued Jun. 18, 1991 to S. Ratanagsu, teaches a device having an L-shaped support block clamped to the overflow tube, a support rod depending from the block, a float member with an upper chamber filled with water and a lower chamber filled with air attached to the rod, and an adjustable sleeve threaded on the bottom of the support bar, the sleeve pressing the flapper valve down on the valve seat.

U.S. Pat. No. 5,103,507, issued Apr. 14, 1992 to Sprajc, et al., shows a device adapted for both flapper and ball valves, having a spring clamp with a pair of horizontal guides attached lo the overflow tube, a U-shaped thrust member for pressing the valve onto the valve seat, the U-shaped member having a pair of vertical arms at the ends of the U with floats mounted on weights circumferentially around the vertical arms which extend through the horizontal guides, and adjustment clips on the vertical arms between the floats and the guides. U.S. Pat. No. 5,185,891, issued Feb. 16, 1993 to L. Rise, describes a device for converting the flapper valve to manual operation in the form of a forked stop disposed on the overflow tube above the flapper valve.

U.S. Pat. No. 5,191,661, issued Mar. 9, 1993 to F. C. Chang, teaches a device which includes a block mounted on the overflow tube, a hanger mounted on the block with a pawl pivotally mounted on the hanger, a float with an extension having protrusions, a pusher with holes which mate with the protrusions on the float extension, and a lever having two chains, one connected to the flapper valve and the other connected to the pawl. U.S. Pat. No. 5,333,331, issued Aug. 2, 1994 to J. R. Battle, shows a hemispherical flush regulator pivotally mounted to the overflow tube above the flapper valve, optionally having a second pivot at the junction of the pivot arm and the flush regulator, which operates in partial flush and full flush modes.

U.S. Pat. No. 5,341,522, issued Aug. 30, 1994 to J. Munro, describes a water conservation device having an elongate cylinder hanging from a side wall of the tank, one end of which is attached to the flapper valve in order to pull the valve closed by the weight of the cylinder. U.S. Pat. No. 5,375,269, issued Dec. 27, 1994 to P. J. Schmitz, discloses a water saving device with a float having an upper cup and a lower cup slidable on the overflow tube, the lower cup having a tongue with dimples which engage holes or depressions on the upper cup in detent fashion to adjust the travel of the float, the float pressing the flapper valve closed on the valve seat.

U.S. Pat. No. 5,548,849, issued Aug. 27, 1996 to A. M. Sulit, shows a flexible line hung from one side of the tank, one end of the line tied to the flapper valve and the other end of the line tied to the float, so that as the float goes down with the drop in water level, the flapper valve is pulled closed on the valve seat. U.S. Pat. No. 5,784,726, issued Jul. 28, 1998 to S. G. Kay, describes a spherical rubber ball with a bore through a diameter of the sphere which slides over the overflow tube in order to limit the upward travel of the flapper valve.

None of the above inventions and patents, taken either singly or in combination, is seen to describe the instant invention as claimed.

SUMMARY OF THE INVENTION

The toilet tank water conservation device has a bracket adapted for attachment to the overflow tube of a toilet tank. The bracket includes a guide ledge having a bore defined therein. The device includes a float ball attached to a cylindrical guide rod, the rod being slidable through the bore defined in the guide ledge. The device is installed so that when the toilet tank is flushed, the water level drops and the ball drops by gravity, striking the flapper flush valve and closing the flush valve early in order to (1) conserve water by limiting the amount of water released from the tank into the bowl, and consequently (2) decreasing the likelihood of overflow from the toilet bowl in the event of a clogged drain. The device may include a flange about the circumference of the rod in order to prevent the rod from sliding through the bore when water drains from the tank.

Accordingly, it is a principal object of the invention to provide a device for a toilet tank having a flapper type flush valve which conserves water by closing the flush valve early in the flush cycle.

It is another object of the invention to provide a device for a toilet tank having a flapper type flush valve which reduces damage from the overflow of a clogged toilet by limiting the volume of water transferred from the tank to the bowl during a flush cycle.

It is a further object of the invention to provide a device which limits the amount of water consumed in flushing a toilet which may be quickly and easily installed without special plumbing knowledge, tools or equipment.

Still another object of the invention is to provide a device which limits the amount of water consumed in flushing a toilet having a minimum of parts which may be economically manufactured from thermoplastic materials.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
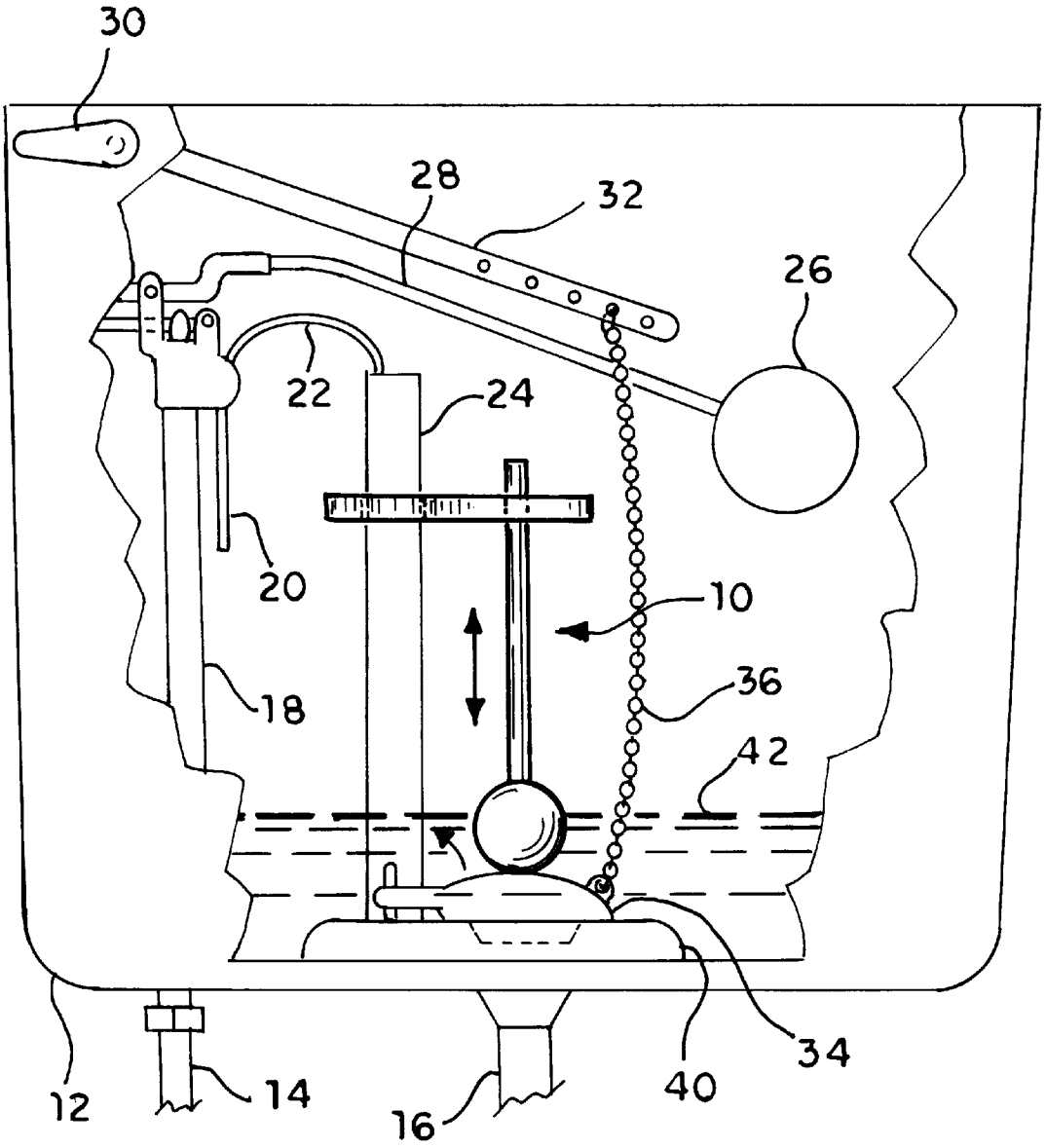
FIG. 1 is an environmental, front view of a toilet tank water conservation device according to the present invention.

The present invention is a toilet tank water conservation device, designated generally as 10 in the drawings. As shown in FIG. 1, a typical toilet tank installation will include a tank :L2 having a pressurized water inlet 14 from the cold water supply entering the base of the tank, and an outlet tube 16 leading to the toilet bowl (not shown). The water inlet 14 is typically connected to a ballcock assembly 18 having a fill tube 20 for filling the tank 12 with water, a refill tube 22 for filling the bowl with water through the overflow tube 24, and a float valve (not shown) for controlling the flow of water into the tank 12 which .is operated by means of a float ball 26 pivotally connected to the ballcock assembly 18 by a float arm 28.

The toilet is operated by manually rotating a handle 30 connected to a lever arm 32. The lever arm 32 is connected to a flapper type flush valve 34 by a flexible member, such as a link chain 36, the flapper valve 34 being pivotally mounted at the base of the overflow tube 24 by a rubber collar which slides over the overflow tube 24, or by a pair of arms which engage mounting ears at the base of the overflow tube 24. When the handle 30 is rotated in a counterclockwise direction, the lever arm 32 pulls the chain 36 up, lifting the flush valve 34 off a flush valve seat 40 mounted above the outlet tube 16. The pressure caused by the weight of the column of water in the tank 12 causes the water to drain through the outlet tube 16 into the bowl either directly or through the leg of a trap in the rear of the bowl, a siphon action causing the bowl to flush through the trap and the sewage disposal pipe system.

As the level of water 42 in the tank 12 drops, the float ball 26 descends, opening the fill valve to fill the tank through the fill tube 20 and the bowl through the refill tube 22. The flapper valve 34 remains in a substantially vertically upright position, buoyed by a hemispherical float on the underside of the valve, until the water level 42 drops far enough for torque and the weight of gravity to gradually lower the valve 34 onto the valve seat 41, virtually all of the water in the tank 42 being drained through the outlet tube 16. Once the flush valve 34 is again seated on the valve seat 40, the water level in the tank 12 rises until the float ball 26 and float arm 28 rise high enough to close the float valve in the ballcock assembly 18, shutting off the water supply.

Figure 2:
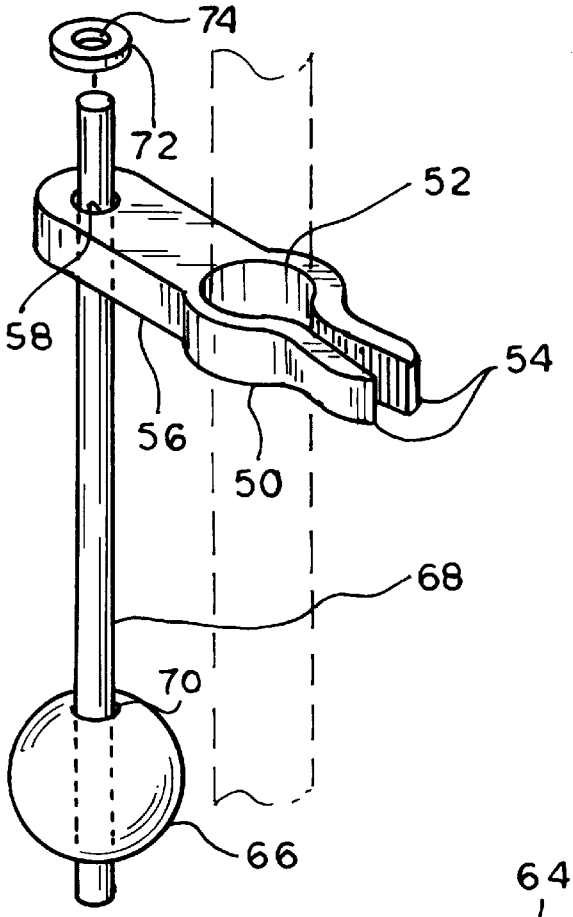
FIG. 2 is a front, perspective view of a toilet tank water conservation device according to the present invention.

The device 10 of the present invention is designed to close the flush valve 34 earlier in the flush cycle, reducing the amount of water 42 drained from the tank 12, thereby conserving water and reducing the likelihood of bowl overflow in the event of a clogged toilet. The device 10, as shown in FIGS. 1 and 2, includes a bracket 50 adapted for attachment to the overflow tube 24. In the embodiment shown, the body of the bracket 50 includes a bore 52 which is circular in cross section, the body being split from the bore 52 to the outer perimeter of the body in order to define a yoke having two arms 54. The bracket is preferably made from a stiff, resilient, thermoplastic material, the diameter of the bore 52 being slightly smaller than the diameter of the overflow tube 24, so that the arms 54 spread slightly as the bracket 50 slides over the overflow tube 24. The bracket 50 may be retained in a fixed position about the circumference of the overflow tube by friction, or by a clamp (not shown) closing the yoke arms 54.

Figure 3:
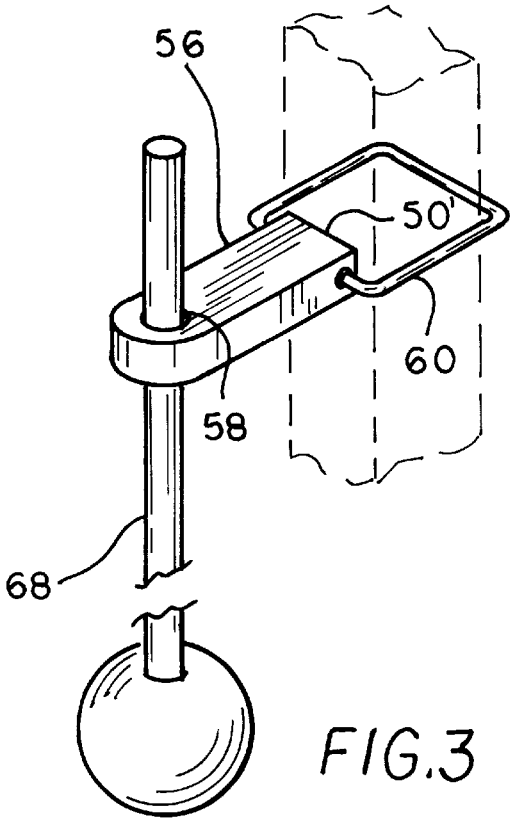
FIG. 3 is a perspective view of an alternative embodiment of the bracket of the toilet tank water conservation device according to the present invention.
Figure 4:
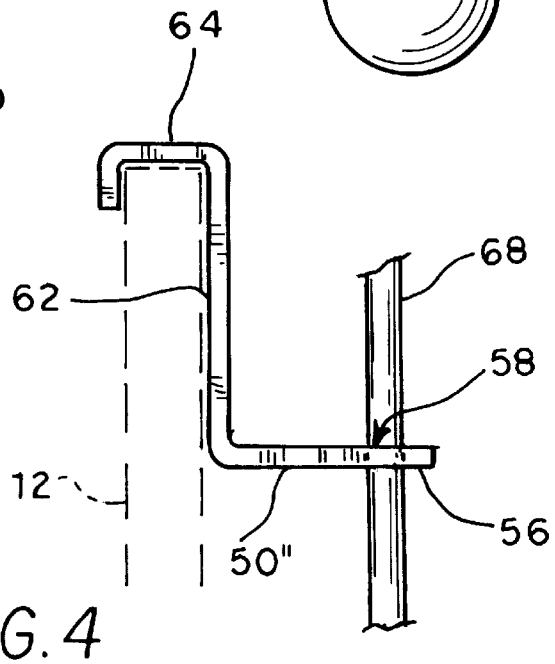
FIG. 4 is a side view of another alternative embodiment of the bracket of the toilet tank water conservation device according to the present invention.

The bracket 50 includes a guide ledge 56 having a bore 58 defined therein. When the bracket 50 is installed on the overflow tube 24, the guide ledge 56 projects over the flapper valve 34 so that the bore 58 is approximately concentric with the valve seat 40 and outlet tube 16. FIGS. 3 and 4 show alternative embodiments of the bracket 50. FIG. 3 shows an embodiment of the bracket 50 having a wire clip 60 adapted for engaging an overflow tube which is square in cross section. FIG. 4 shows an embodiment of the bracket 50 having a vertical riser 62 terminating in a U-shaped hook 64 adapted for hanging over the top edge of a wall of the tank 12.

The device 10 includes a spherical float ball 66 and a guide rod 68. The float ball 66 has a bore 70 extending through the ball 66, an end of the guide rod 68 extending into and/or through the bore so that the depth to which the guide rod extends into or through the bore 70 may be adjusted either by frictional engagement of the bore 70 with the rod 68, by threaded engagement of the bore 70 and rod 68, by set screw, or by any other conventional means known in the industry. The float ball 66 and the guide rod 68 are preferably made from a thermoplastic material and the ball 66 is buoyant enough to rise clear of the flapper valve 34 as the water level 42 rises, but heavy enough in combination with the guide rod 68 to press the flapper 34 to a closed position firmly seated on the valve seat 40 when the water level falls during the flush cycle. The outer diameter of the guide rod 68 is slightly smaller than the diameter of the bore 58 defined in the guide ledge 56 so that the guide rod is slidable in the bore 58.

The device is installed by sliding the bracket over the overflow tube 24 and flushing the toilet. The bracket 50 and float ball 66 are aligned so that the ball 66 strikes the flapper 34 when the tank 12 is empty, as shown in FIG. 1. The device 10 may optionally include a gasket 72 made from rubber or a synthetic, elastomeric material, and having a bore 74 defined therein slightly smaller in diameter than the outside diameter of the rod 68. The gasket 72 slides over the guide rod 68 to provide a flange which prevents the free end of the guide rod 68 from sliding out of the bore 58 in the guide ledge 56 as the water 42 drains from the tank 12. Alternatively, the free end of the rod 68 may have a flange integral therewith.

In operation, when the tank 12 is full of water 42, the ball 66 and guide rod 68 are raised by the buoyancy of the float ball 66 through the bore 58 in the guide ledge 56 of the bracket 50, the degree of travel being limited on the one hand by the length of the rod 68, and on the other hand by the height of the tank 12 and the tank lid (not shown). The flapper or flush valve 34 is held firmly seated on the valve seat 40 by the weight of the water 42. The distance between the top surface of the flush valve 34 and the ball 66 is sufficient to allow the flapper 34 to pivot to either a full or partially open position when the handle 30 is rotated in a counterclockwise direction. When the toilet is flushed, the water drains through the open valve and through the outlet tube 16. A,s the water level 42 in the tank 12 drops, the ball 66 strikes the flapper valve 341 and the combined weight of the ball 66, rod 68 and flapper valve 34 are sufficient to press the flush valve 34 firmly closed on the valve seat 40 before all of the water 42 drains from the tank 12. The reduced volume of water draining from the tank 12 into the bowl conserves water and helps to prevent clogged toilets from overflowing the bowl.

It is to be understood that the present invention is not limited to the sole embodiments described above, but encompasses any and all embodiments within the scope of the following claims.

I claim:

1. A toilet tank water conservation device for use with a toilet having a flapper type flush valve pivotally mounted in a toilet tank for holding tank water at the base of an overflow tube, comprising;

a) a bracket adapted for attachment to the overflow tube, the bracket having a body and a first bore defined in the body adapted for slidably engaging the overflow tube, and a guide ledge projecting from the body and having a second bore defined therein;

b) a float ball, the ball being spherical and having a bore defined diametrically through said ball, the float ball being buoyant;

c) a guide rod having a first end and a second end, the first end being slidably disposed in the bore defined in the guide ledge, and the second end extending into the bore defined in said float ball, the depth to which the second end extends into the bore being adjustable; and d) wherein said float ball and said guide rod are disposed above said flush valve and aligned therewith so that said float ball and said guide rod slide down in order to seat said valve in a closed position when the level of the tank water falls, and said float ball and guide rod rise when the level of tank water rises in order to allow the flapper valve to pivot to an open position.

2. The toilet tank water conservation device according to claim 1, wherein said bracket, said float ball and said guide rod are made from a thermoplastic material.

3. The toilet tank water conservation device according to claim 1, wherein said bracket has a slot defined in the body extending radially from the bore through the body and defining a yoke shape having two arms.

4. The toilet tank water conservation device according to claim 3, further comprising a clamp adapted for closing the two arms in order to clamp said bracket to an overflow tube.

5. The toilet tank water conservation device according to claim 1, further comprising a gasket, said gasket being made of an elastomeric material and having a bore defined therein, said gasket being disposed about the second end of said guide rod in order to form a flange for preventing said guide rod from sliding out of engagement with said bracket when the water level in the toilet tank falls.

* * * * *